US009770061B2

(12) United States Patent
Sansone

(10) Patent No.: US 9,770,061 B2
(45) Date of Patent: Sep. 26, 2017

(54) EMERGENCY HEAD COVERING COLD PACK FOR HEAD TRAUMA, CONCUSSIONS, WOUNDS OR MIGRAINES

(71) Applicant: Stanley A. Sansone, Houston, TX (US)

(72) Inventor: Stanley A. Sansone, Houston, TX (US)

( * ) Notice: Subject to any disclaimer, the term of this patent is extended or adjusted under 35 U.S.C. 154(b) by 305 days.

(21) Appl. No.: 14/611,308

(22) Filed: Feb. 2, 2015

(65) Prior Publication Data

US 2016/0219965 A1 Aug. 4, 2016
US 2017/0065020 A9 Mar. 9, 2017

Related U.S. Application Data

(60) Provisional application No. 62/022,391, filed on Jul. 9, 2014.

(51) Int. Cl.
*A42B 3/00* (2006.01)
*A42B 3/28* (2006.01)
*A42B 1/00* (2006.01)

(52) U.S. Cl.
CPC ..... *A42B 3/285* (2013.01); *A42B 1/008* (2013.01); *A42B 3/00* (2013.01)

(58) Field of Classification Search
CPC ..... A42B 1/008
USPC ..... 607/110
See application file for complete search history.

(56) References Cited

U.S. PATENT DOCUMENTS 4,552,149 A * 11/1985 Tatsuki ..... A42B 1/008 607/110
4,908,248 A * 3/1990 Nakashima ..... A61F 7/10 383/37
6,312,453 B1 * 11/2001 Stefanile ..... A61F 7/10 607/108
7,028,344 B2 * 4/2006 Toth ..... A42B 3/10 165/46
9,149,393 B2 * 10/2015 Cumming ..... A61F 13/12
2013/0152274 A1 * 6/2013 Welch ..... A42B 1/008 2/171.2
2015/0297397 A1 * 10/2015 Rand ..... A42B 1/008 607/110
2015/0342279 A1 * 12/2015 Haggard ..... A42B 1/008 2/171.2
2016/0030238 A1 * 2/2016 Foster ..... F25D 5/00 607/110

* cited by examiner

*Primary Examiner* — Joshua Kennedy

(57) ABSTRACT

A method and apparatus for the treatment of injuries or pain associated with the head or central nervous system. The present embodiment utilizes a head covering that is activated to produce an endothermic reaction to draw heat from, or apply cold to, the head and central nervous system. Layers are used to accomplish different applications and colors are used to associate with selected sport teams colors or camouflaged as may be required in a battlefield environment.

21 Claims, 6 Drawing Sheets

EMERGENCY HEAD COVERING COLD PACK FOR HEAD TRAUMA, CONCUSSIONS, WOUNDS OR MIGRAINES

FIELD OF THE INVENTION

This invention relates generally to a method and apparatus for the treatment of injuries or ailments of the head area including but not limited to head injury, bleeding, concussion, migraine, seizures or heat stroke through the application of accessible cold therapy. It is the intention of the current invention to be used or deployed immediately after sports injuries, injuries on the battlefield, injuries resulting from automobile accidents or other events that result in injury or pain to the head or central nervous system. It is well known that the quick application of cold treatments reduces swelling or reduces pain after events such as injuries to the head. The timely deployment of form fitting cold therapy compress device reduces the effects of an injury and in many instances arrest the injury from worsening. In addition, reoccurring medical conditions such as migraines, seizures or heat prostration will also benefit from a timely application or deployment of a cold head compress.

BACKGROUND OF THE INVENTION

Cryotherapeutic or cold therapy helps reduces pain, arrests swelling, decreases the hyperactivity of the central nervous system and decreases vasodilation during bleeding. Advantages of emergency application of cold therapy are well known but not often used because it is difficult to carry ice around and/or the time needed to freeze water or materials for emergency use is time prohibitive. As an example, Cumming et al., U.S. Pat. No. 8,262,601 calls for ice to be inserted into a helmet.

Cryotherapeutic application during emergency situations often times may be an instant ice pack. An instant ice pack is a containment pack consisting of a small bag of water and other materials, such as ammonium nitrate, calcium ammonium nitrate, urea, or others. An endothermic reaction is commenced when the water bag in the pack is broken which facilitates the mixing with or dissolving of these other materials in the pack. Such instant cold packs are square or rectangular or some other flat shape. These flat shapes are difficult to attach to the head area and are difficult to put on and remove, often times requiring long bandages to wrap around the head.

Pressure helps arrests swelling, decreases the hyperactivity of the central nervous system and decreases vasodilation during bleeding. The application of pressure is often times difficult for injuries or ailments of the head. Form fitting devices for the head are often times not available during emergency situations.

Immediately after an injury to the head, especially with a laceration, an absorbent layer or gauze pad may be placed on the head to arrest the bleeding. This requires holding it in place which is problematic for attending emergency personnel. Wrapping a bandage around the head to secure the gauze pad is also problematic since the head is a partial globe in form and wrapping requires significant movement of the head.

Oftentimes a patient's head is exposed to the elements and application of any cold treatment absorbs heat from the environment instead of the patients head.

Placing of a helmet type device that cover a substantial portion of the head often times requires the helmet to be pulled onto the head from above or slightly from the back of the head. This may cause further injury.

SUMMARY OF INVENTION

The present invention addresses the timely deployment, as in an emergency application, of cryotherapeutic or cold therapy treatment for the head. An emergency head covering cold pack helmet reduces pain, arrest swelling, decreases the hyperactivity of the central nervous system, decreases vasodilation during bleeding and other injuries to the head. For example, emergency application of a cryotherapeutic cooling helmet is useful in simply arresting vasodilation during internal bleeding of the head, like a severe contusion.

It is the intention of the present invention to supply a form fitting head covering secured to the head to aid in the timely application of pressure. The timely application of pressure also helps arrests swelling, decreases the hyperactivity of the central nervous system and decreases vasodilation during bleeding. A form fitting head covering also aids in holding the cryotherapeutic treatment to the head.

In addition it is the intention of the present invention to provide an absorbent and non-stick layer fitted to the head to absorb bleeding or other liquids appearing around the head.

In addition it is the intention of the present invention to provide an insulating layer. Said insulating layer provides some physical and thermal protection for the head. Said insulating layer limits the heat from the environment thus increasing the efficiency of the instant cold pack. Instead of the instant cold pack absorbing heat from the environment the insulating layer only allows heat into the instant cold pack from the head, thus providing greater cooling therapy for the patient's head. In addition, pockets may be attached to said insulating layer so that instant cold packs could be inserted making the emergency head covering reusable, further providing a positive environmental impact.

In addition it is the intention of the present invention to provide ports positioned on the helmet and around the head. Said ports provide for the transfer of sound, adding additional cold treatments and observation of the head. For example said ports can be used to observe bleeding or other liquids appearing around the head. Also prepositioned ports around the ears can aid the transmission of sound energy or communication with the injured party.

In addition it is the intention of the present invention to provide seams in the helmet such that by using a connecting material such as a hook and loop fastening components system the emergency head covering may be formed during the deployment event where the said head covering wraps around the head minimizing head movement after the injury.

DETAILED DESCRIPTION OF THE PREFERRED EMBODIMENTS

Figure 1:
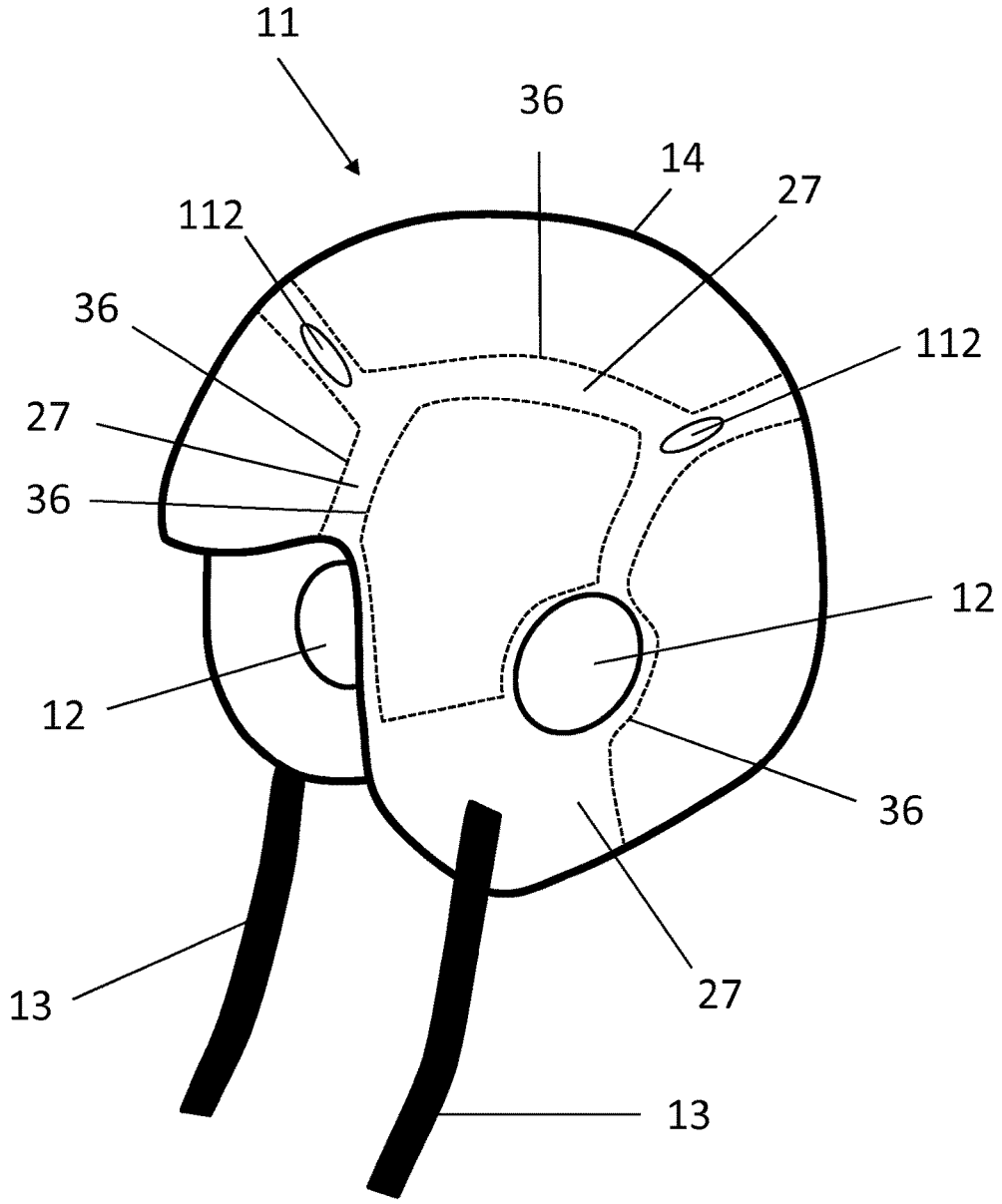
FIG. 1 shows the emergency head covering that covers a substantial portion of the head.

Referring to FIG. 1, emergency head cover 11 covers substantially a significant portion of the head. This includes the top of head, sides of head, forehead and back of the head to at least the base of the skull. Corresponding brain tissue to be covered includes: Frontal lobe, Parietal lobe, Temporal lobe (2 sides), Occipital lobe and Cerebellum. FIG. 1 shows a view of the helmet with seams 27 and enclosed measured volumes 36. Enclosed measured volume 36 is a containment pack filled with material or materials capable of producing an endothermic reaction upon activation as in an instant cold pack. Said enclosed measured volume 36 outlines are shown as dashed lines. Outer most layer 14 is the layer seen by others or when the patient looks in a mirror. Said outer most layer 14 may be of a particular color that is used to associate with sports team colors or camouflaged as may be required in a battlefield environment. Transmission port 12 is meant to undercover the ear to allow for control transmissions of sound energy. Transmission port 12 may consist of a simple hole to allow communications to the injured. Transmission port 12 may also consist of material or a device to block or cancel harmful sound energy. An example of harmful sound is, in a war zone or emergency helicopter transport where loud or menacing sound energy could cause additional harm or cumulative damage. Another example of controlled transmission of sound energy through transmission ports 12 is to use ear phones for communication in an emergency helicopter transport where EMS personnel can more effectively communicate to patient being transported. Other ports 112 may allow for visual observation of the head including but not limited to, type of fluids, blood and are different from transmission ports 12 used to uncover the ears. Said other ports 112 may also be used to recharge instant cold pack, insertion of medical devices or materials. Strap 13 is attached to emergency head cover 11 for securing the apparatus to the head. Two straps 13 may be tied together to secure the apparatus to the head. One strap 13 may also be used with a hook and loop fastening system. Said single strap 13 fastening system may consist of stretchable material with one component of hook and loop fastening system attached to the end of said single strap 13. Said single strap 13 is then stretched and connected to the other side of the emergency head covering where there is the opposite component of the hook and loop fastening system is attached and serves as a landing zone for said single strap 13. This aids to gently secure emergency head covering 11 to patients head and applies some pressure. Said outer most layer 14 may be of a particular color that is used to associate with sports team colors or camouflaged as may be required in a battlefield environment.

Figure 2A:
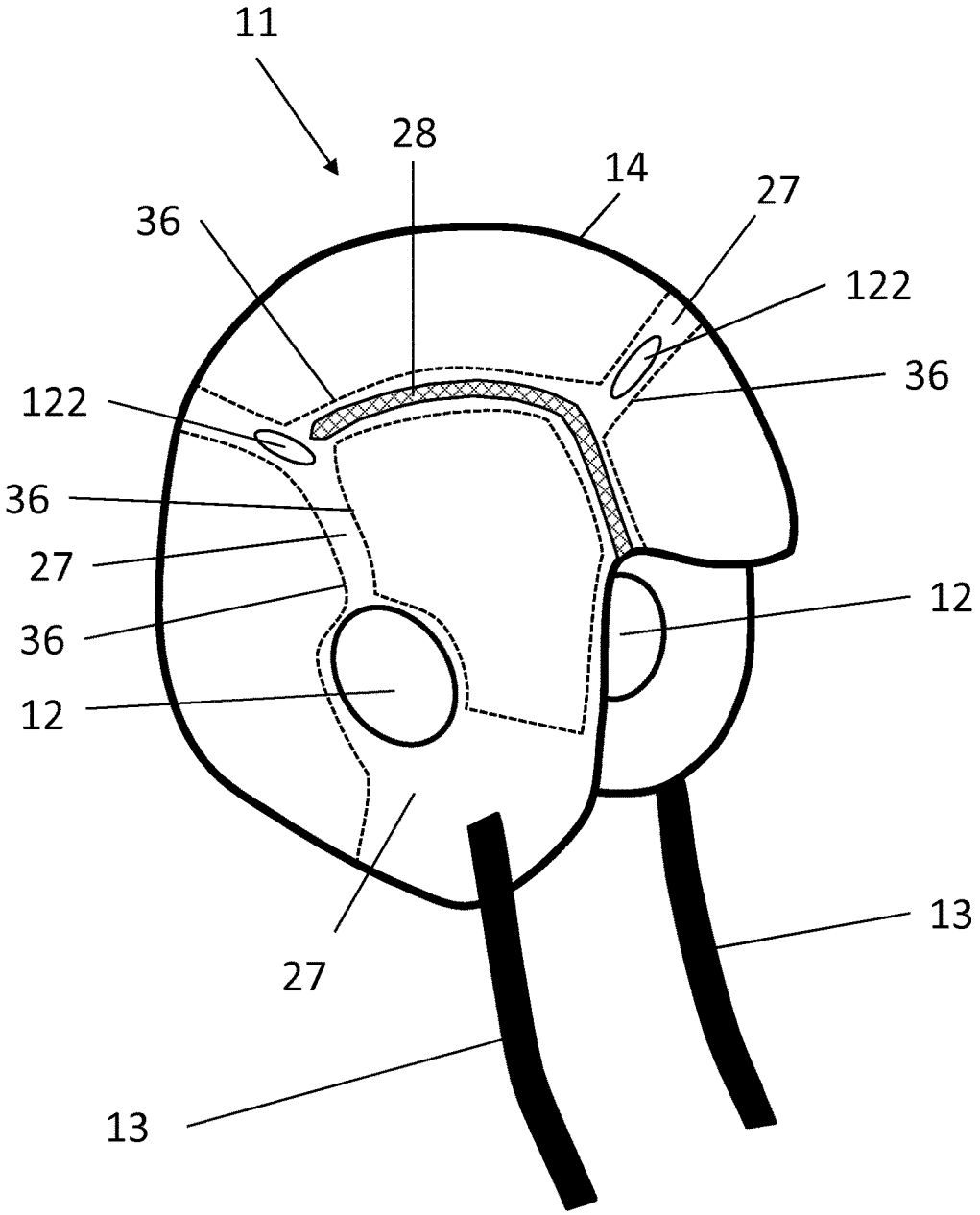
FIG. 2A shows an emergency head covering with a deployment seam.
Figure 2B:
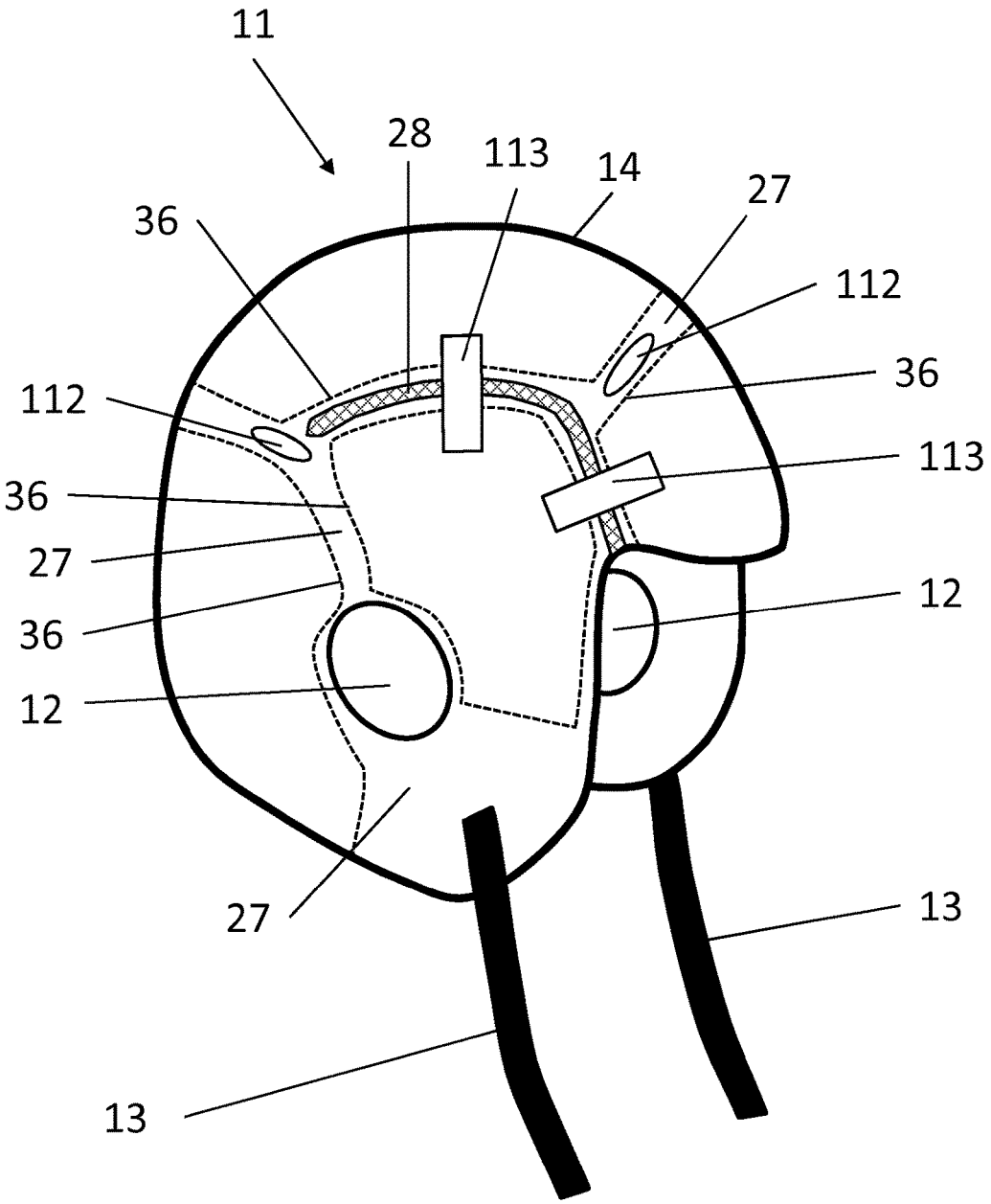
FIG. 2B shows a disposable emergency head covering with a deployment seam using tape fasteners.

FIG. 2A shows said seams 27 which may serve to separate enclosed measured volumes 36. Deployment seam 28 is a component of a fastening system that aids in positioning the emergency head covering 11 around the head and is used to merge portions of apparatus during a deployment event. Said deployment event means when an emergency head covering is activated to start an endothermic reaction and placed on the head of a patient. Said deployment seam 28 provides an opening such that the emergency head covering 11 could be wrapped around the head in the form of a helmet thus minimizing the movement of the head. Normally a helmet type device is put on or deployed by sliding the helmet over the head. This action of sliding a helmet may cause additional trauma to a patient with a head injury or any other injury to the central nervous system. There may be more than one deployment seam 28 to further aid in wrapping the emergency head covering around the head. One embodiment is said deployment seam 28 may consist of hook and loop closing components construction to close and finally form the emergency head covering (FIG. 4A). In a preferred embodiment of a disposable apparatus shown in FIG. 2B, said deployment seam 28 is a simple seam 27 that opens like a flap where at least one tape fastener 113 is used to close or complete the deployment of the emergency head covering 11. Tape fasteners 113 are attached to the one side of the head covering and transversely attached to a landing zone 213 (FIG. 4B) to close and finally form the head covering around the head.

Figure 3:
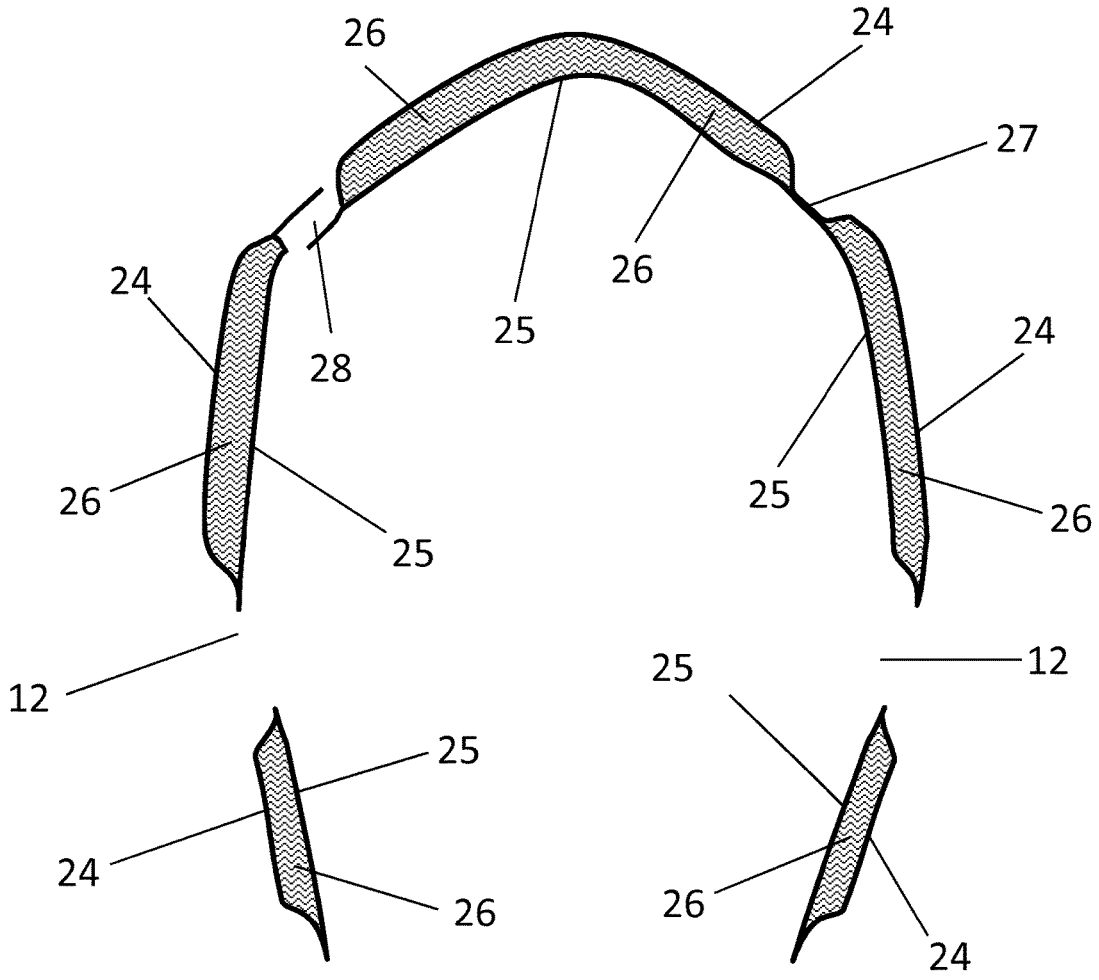
FIG. 3 shows a cross sectional view of a basic emergency head covering.

Referring to FIG. 3 showing a cross sectional view of emergency head cover 11 (FIG. 1). All layers between the patients head and said enclosed measured volume 36 are called inner layers. All layers from out away from the patients head and out and away from the enclosed measured volume 36 are outer layers. Outer layer 24 is joined with inner layer 25 to form said enclosed measured volume 36 much like a containment packet (FIG. 1). Outer layer 24 and inner layer 25 may consist of plastic, nylon, other or some combination of materials forming a containment packet capable of holding endothermic materials. Said enclosed measured volume 36 contains endothermic materials 26 capable of causing an endothermic reaction upon activation. Endothermic materials 26 for example may be ammonium nitrate and a bag of water. Other materials may be calcium ammonium nitrate, urea, or others. Activation of the reaction is a simple squeezing and bursting of the water bag. When said endothermic materials 26, ammonium nitrate and a bag of water, mixes an endothermic reaction results as in an instant or disposable cold pack, thus providing emergency cold treatment to a substantial portion of the head. Seam 27 is the sealed or joined part of outer layer 24 and inner layer 25. Inner layer 25, outer layer 24, seam 27 and endothermic materials 26 may form an instant cold pack. Multiple instant cold packs may be pre-combined with seams 27 to form the emergency head cover 11. The above description represents the simplest and unique embodiment of the emergency head covering. Deployment seam 28 is one embodiment that aids in forming the emergency head covering 11. It is recognized that FIG. 3 shows outer layer 24 is also the outer most layer 14 (FIG. 1) in this preferred embodiment or configuration of said emergency head covering 11.

Figure 4:
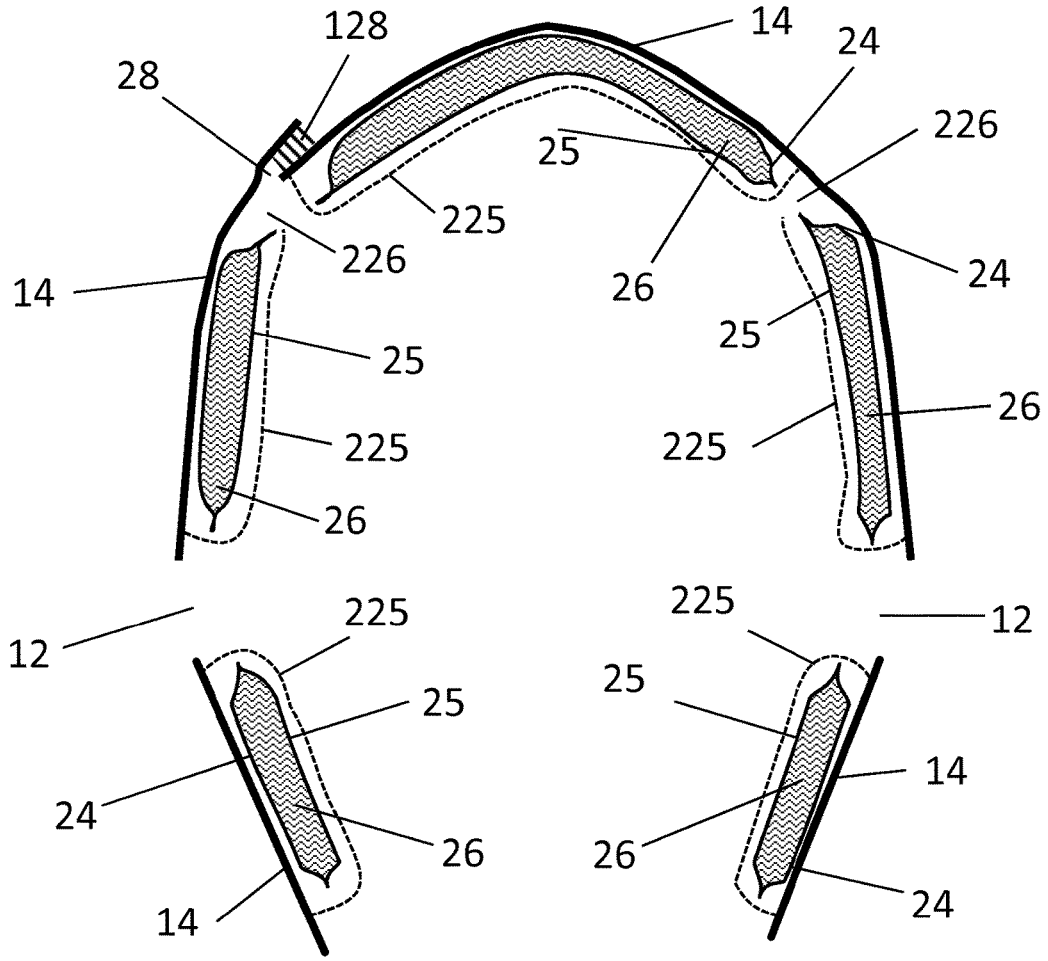
FIG. 4 shows a cross sectional view of emergency head covering where there are 2 outer layers and 2 inner layers.

FIG. 4 shows cross sectional view of emergency head cover 11 (FIG. 1) a particular embodiment where outer most layer 14 consists of a shell made of different material such as neoprene. Outer most layer 14 may have pockets or inner most layer 225 attached to it to facilitate insertion of separate instant cold packs. Said instant cold packs are composed of outer layer 24 is joined with inner layer 25 to form said enclosed measured volume. Said enclosed measured volume is filled with endothermic materials 26. Pockets or inner most layer 225 is the layer closest to the patients head and has openings 226 such that instant cold packs may be inserted and removed. Pockets or inner most layer 225 represents an inner most layer and is different from inner layer 25. Deployment seam 128 shows hook and loop closing components construction to close and finally form the emergency head covering 11

Figure 5A:
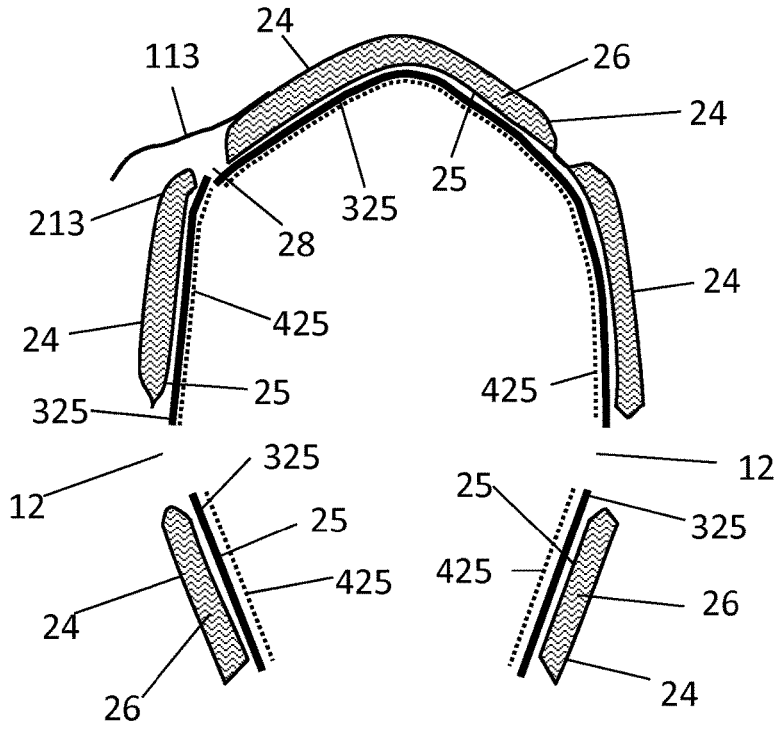
FIG. 5A shows a cross sectional view of emergency head covering where there are 3 inner layers.
Figure 5B:
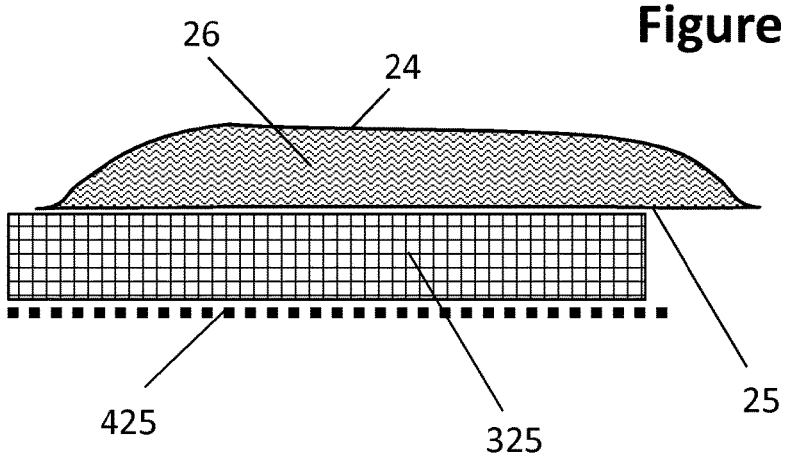
FIG. 5B show an expanded view of a section of FIG. 5A a cross section of emergency head covering depicting 3 inner layers.

FIG. 5A shows cross sectional view of a disposable embodiment of emergency head cover 11 (FIG. 1) with 3 inner layers, inner layer 25, inner absorbent layer 325 and inner most film layer 425. Said inner layer 25 is sealed with outer layer 24 to create said enclosed measured volumes filled with endothermic materials 26. Said inner absorbent layer 325 is an absorbent layer that may consist of cotton, absorbent polymer fibers or absorbent particles meant to collect blood or other fluids that are on or around the patients head. Said inner most film layer 425 is a porous sheet to allow blood or other fluids to pass through from the head and into the inner absorbent layer 325. Ideally inner most film layer 425 is non-stick so as the emergency head covering is removed from the patient at a location where emergency medical staff need access to the patients' head, as in a hospital, hair or skin of the patients head will not be fused to the emergency head covering. FIG. 5B shows an expanded view of a section of FIG. 5A a cross section of emergency head covering depicting the 3 inner layers. Said layers, inner layer 25, inner absorbent layer 325 and inner most film layer 425 are meant to attached to form a single shell for the disposable emergency head cover 11.

What is claimed:

1. A method of deploying emergency cold treatment to a head comprising:

activating at least one instant cold pack, wherein said at least one instant cold pack comprises:

at least one outer layer and at least one inner layer defining a helmet configured to accept a head, said helmet including, but not limited to, a top portion, side portions, a forehead portion, a back of the head portion to at least the base of a skull, and transmission ports to uncover the ears, wherein the helmet has a front opening for the face;

at least one deployment seam extending from said front opening of said helmet either into at least one of or between two of said top, side, and forehead portions of said helmet above said transmission ports of said helmet;

enlarging said front opening by opening said at least one deployment seam to place said helmet around a head;

wrapping said at least one instant cold packs in a helmet configuration around a head;

closing said at least one deployment seam with at least one fastener to securing said helmet to a head.

2. A method of deploying emergency cold treatment to a head of claim 1 wherein said activating is the squeezing of instant cold pack.

3. A method of deploying emergency cold treatment to a head of claim 1 wherein said configuration is predetermined shapes and positions of said at least one instant cold pack.

4. A method of deploying emergency cold treatment to a head of claim 1 wherein said emergency cold treatment absorbs fluids around a head.

5. A method of deploying emergency cold treatment to a head of claim 1 wherein said emergency cold treatment comprises inserting said at least one instant cold pack into a corresponding pocket.

6. A method of deploying emergency cold treatment to a head of claim 1 wherein said at least one outer layer comprises camouflage.

7. A method of deploying emergency cold treatment to a head of claim 1, wherein at least one strap is configured to secure to a head.

8. A method of deploying emergency cold treatment to a head of claim 1, wherein said transmission ports control sound transmission to the patient.

9. An emergency therapeutic head covering comprising at least one outer layer and at least one inner layer defining a helmet configured to accept a head, said helmet including, but not limited to, a top portion, side portions, a forehead portion, a back of the head portion to at least the base of a skill, and transmission ports to uncover the ears, wherein the helmet has a front opening for the face;

said at least one outer layer and said at least one inner layer are sealed to create at least one internal volume, said at least one internal volume is configured to cover a substantial portion of a head, said at least one internal volume contains materials capable to activate an endothermic reaction;

at least one deployment seam extending from said front opening of said helmet either into at least one of or between two of said top, side, and forehead portions of said helmet above said transmission ports of said helmet to enlarge said front opening to facilitate the wrapping of said helmet around a head;

said at least one deployment seam comprises at least one fastener to close said at least one deployment seam and form the head covering.

10. An emergency therapeutic head covering of claim 9 wherein each said at least one internal volume has a predetermined shape and position.

11. An emergency therapeutic head covering of claim 9 wherein said transmission ports comprise means to control sound transmission.

12. An emergency therapeutic head covering of claim 9 wherein at least one strap is configured to secure to a head.

13. An emergency therapeutic head covering of claim 9 wherein said at least one layer is absorbent.

14. An emergency therapeutic head covering of claim 9 wherein an inner most layer of said at least one inner layer is permeable to liquids to prevent head covering from sticking to head.

15. An emergency therapeutic head covering of claim 9 wherein an outer layer of said at least one outer layer is insulation.

16. An emergency therapeutic head covering of claim 9 wherein an outermost layer of said at least one outer layer comprises camouflage.

17. A therapeutic head covering comprising:

at least one layer defining a helmet configured to accept a head, said helmet including, but not limited to, a top portion, side portions, a forehead portion, and a back of the head portion to at least the base of a skill, wherein the helmet has a front opening for the face, said layer having at least one pocket attached thereto;

each of said at least one pockets holding a corresponding containment packet within an opening;

each said containment packet containing materials to activate an endothermic reaction;

at least one deployment seam extending from said front opening of said helmet either into at least one of or between two of said top, side, and forehead portions of said helmet above said transmission ports of said helmet to enlarge said front opening to facilitate the wrapping of said helmet around a head;

said at least one deployment seam comprises at least one fastener to close said at least one deployment seam and form the head covering.

18. A therapeutic head covering of claim 17 wherein each pocket has a predetermined shape and position.

19. A therapeutic head covering of claim 17 wherein said transmission ports comprise means to control sound transmission.

20. A therapeutic head covering of claim 17 wherein at least one strap is configured to secure to a head.

21. A therapeutic head covering of claim 17, wherein an outermost layer of said at least one outer layer is color selected.

* * * * *